US005375430A

United States Patent [19]

Siegel

[11] Patent Number: 5,375,430

[45] Date of Patent: Dec. 27, 1994

[54] GRAVITY POWERED SHOE AIR CONDITIONER

[76] Inventor: Israel Siegel, 2980 Point East Dr., Apt. D-612, N. Miami Beach, Fla. 33160

[21] Appl. No.: 131,389

[22] Filed: Oct. 5, 1993

[51] Int. Cl.[5] ..... F25D 23/12

[52] U.S. Cl. ..... 62/259.3; 62/467; 62/498; 417/473

[58] Field of Search ..... 62/259.3, 467, 498, 62/499; 417/472, 473

[56] References Cited

U.S. PATENT DOCUMENTS

| | | | |
|---|---|---|---|
| 2,051,450 | 9/1960 | Fischer | 417/473 |
| 3,539,277 | 11/1970 | Andrews et al. | 417/473 |
| 3,916,911 | 11/1975 | Sauder et al. | 62/259.3 |
| 5,141,412 | 8/1992 | Meinz | 417/473 |

FOREIGN PATENT DOCUMENTS

| | | | |
|---|---|---|---|
| 744943 | 1/1933 | France | 62/498 |
| 975954 | 10/1950 | France | 62/498 |
| 21304 | 10/1905 | United Kingdom | 417/473 |

OTHER PUBLICATIONS

McQuiston et al., Heating Ventilating and Air Conditioning, 1982, pp. 574–575.

*Primary Examiner*—John M. Sollecito

[57] ABSTRACT

A compressor-expander type cooling, or heating system, is incorporated into a heel of a shoe, and is powered by reciprocal gravity pressures upon the shoe which occur naturally during walking. The cooling system functions through a bellows compressor chamber and a separate bellows expander chamber. The movable walls of the expander and the compressor are placed opposite each other, and transmit opposing vector forces to each other. A movable heel portion at the bottom of the shoe transmits movement to the movable walls of the compressor and the expander whenever the person wearing the shoes steps on the heel. This expands the expander and compresses the compressor. A network of heat exchange coils, containing a low boiling point liquid, communicates with the expander, and functions as heat absorbing evaporator. Another network of heat exchange coils communicates with the compressor chamber, and functions as a heat delivering condenser. Depending on the locations the evaporator and the condenser networks, the shoe can serve as a foot cooler or a foot warmer.

8 Claims, 2 Drawing Sheets

GRAVITY POWERED SHOE AIR CONDITIONER

SUMMARY

A top bellows bellows chamber which functions as a compressor is placed over a bottom bellows chamber which functions as an expander. The expander and compressor are incorporated into a heel of a shoe. Each contains a movable wall which respoonds to pressures inside and outside of the chambers. The chambers are fixed in relative positions that cause the movable walls of the chambers to face each other horizontally and to transmit opposing up and down vector forces to each other. The distance between the chambers is fixed to prevent the movements of the chambers towards and away from each other and to provide space for the movements of the flexible walls between the chambers. When the pressures in the chambers are below atmospheric pressure the movable walls of the chambers exert opposing pulling vector forces to each other. When the pressures in the chambers are above atmospheric pressures the movable walls of the chamber exert opposing pushing vector forces on each other. The walls settle in a position between the chambers which is the result of the balance of the opposing vector forces acting upon the walls. When a person wearing the shoes steps on the shoe, a force transmitting movable heel at the bottom of the shoe transmits an upward vector force upon the movable walls. This tips the balance of forces between the movable walls and causes an expansion of the bottom expander chamber and a contraction of the top compressor chamber. When the movable walls reach a predetermined upward limit of travel a communication is established between the expander and the compressor chambers. A network of coils communicates with the expander chamber and functions as an evaporator chamber. Another network of coils communicates with the compressor chamber and functions as a condenser chamber. The networks contain a low pressure refrigerant such as water under a vacuum, or a high pressure refrigerant, such as freons or Forane, which respond to the the expansion and compression of the chambers. The expansion of the expander chamber causes an evaporation of the liquid and an absorption of heat in the evaporator network. The compression of the compressor chamber causes a compression of vapor in the condenser network. When the person wearing the shoes lifts the shoe off the ground the outside force acting upon the movable wall is removed and the natural flexibility of the bellows returns the movable walls to their original starting positions, This causes a transfer of the expanded vapor from the expander to the compressor chamber, through the communication between the chambers. The compressed vapor in the chamber loses heat to its surrounding and re-condenses into a liquid. The liquid accumulates in the bottom of the condenser. When the liquid reaches a predetermined level it activates a float valve, and the water returns to the evaporator chamber by force of gravity to continue the heat exchange cycle. Depending on the positions of the evaporator and the condenser the invention can function as a shoe cooler or a shoe warmer.

DETAILED DESCRIPTION

Figure 1:
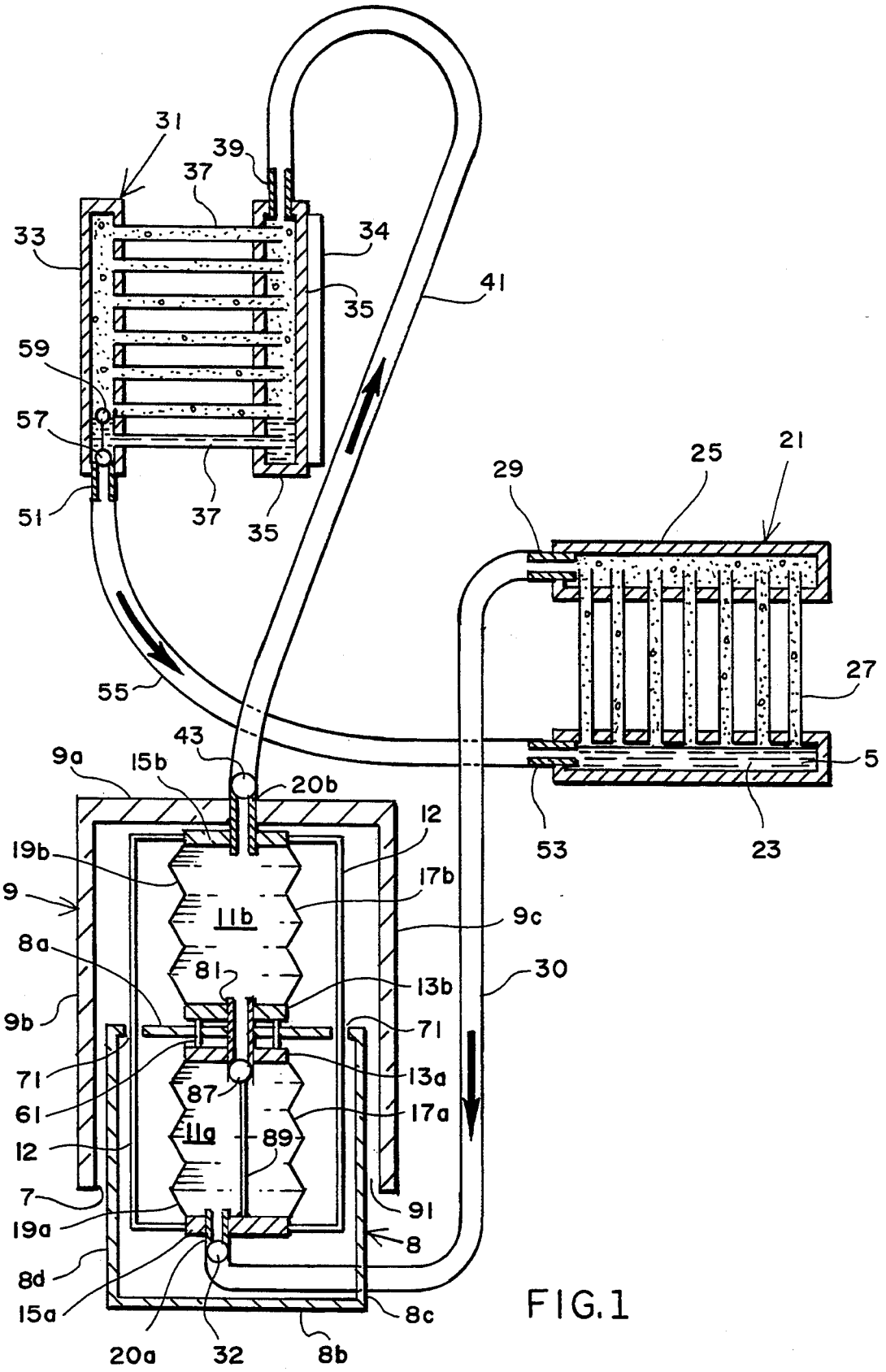
FIG. 1 is a cross-sectional view of the temperature changer.
Figure 2:
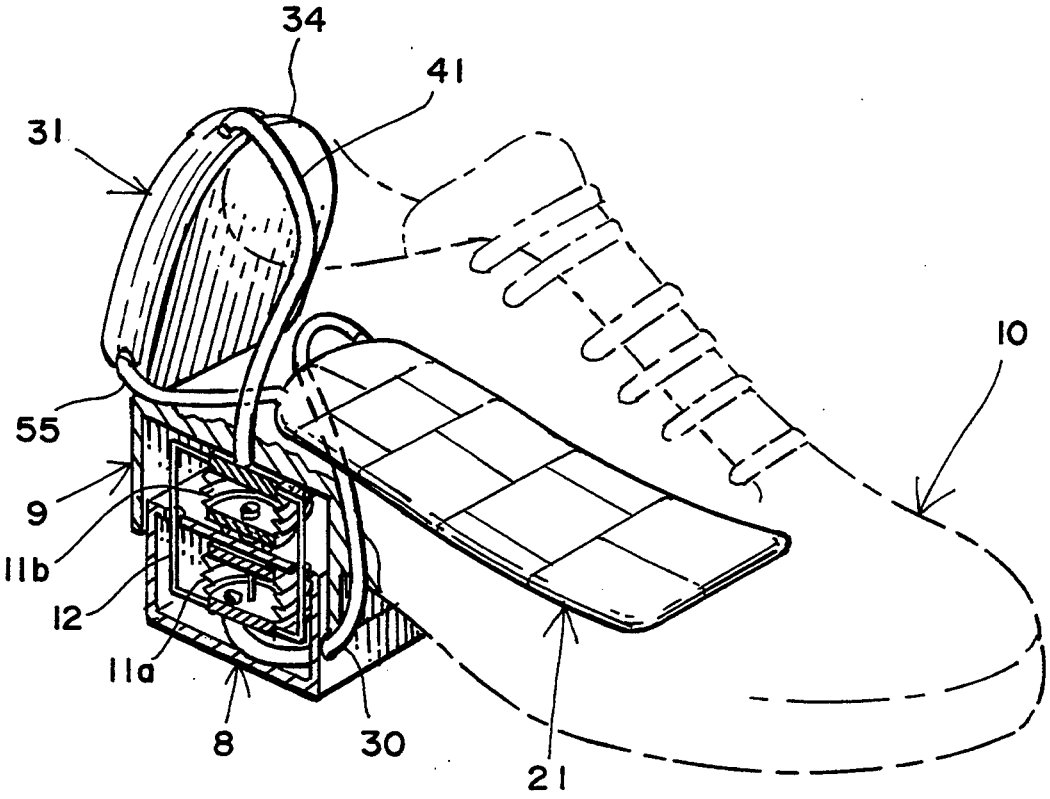
FIG. 2 is a three dimensional view of a shoe cooler.

As seen in FIG. 1 and FIG. 2 there is present a shoe 10. The shoe has a hollow heel 9. Heel 9 has a top surface **9*a*, side surfaces 9*b* and 9*c*, and a bottom open border 7. Present in the upper portion of the inside of heel 9, is a chamber 11*b*. The chamber functions as a compressor chamber, as will be described, Chamber 11*b* contains a bottom wall 13*b*, a top wall 15*b*, and side walls 17*b* and 19*b*. Top wall 15*b* is attached to the inside surface of top wall 9*a* of heel 9, This fixes the position of chamber 11*b* inside heel 9. Side walls 17*b* and 19*b* consist of bellows which allow bottom wall 13*b* to move up and down in a reciprocating manner. When wall 13*b* moves down bellows walls 17*b* and 19*b* change from a folded to an extended position. This increases the volume of chamber 11*b*. When wall 13*b* moves up bellows walls 17*b* and 19*b* change from an extended to a folded position. This decreases the volume of chamber 11*b*. The size and number of the folds in the bellows are such that the bellows allows a sufficient distance of travel of wall 13*b*. A small natural spring force of bellows walls 17*b* and 19*b* tends to keep the bellows walls in a folded position. The walls of chamber 11*b* are made of good insulating materials such as plastic to prevent an exchange of heat between bellows chamber 11*a* and the environment. Penetrating the top wall 15*b* of chamber 11*b* is an outlet tube 20*b***.

Present in heel 9 below chamber **11*b* is a second chamber 11*a*. Chamber 11*a* is similar to chamber 11*b* and its similar components have been given similar numbers marked by the subscript a. The chamber functions as am expander chamber, as will be described. The chamber contains a top wall 13*a*, a bottom wall 15*a*, and side walls 17*a* and 19*a*. Side walls 17*a* and 19*a* consist of bellows which allow top wall 13*a* to move up and down in a reciprocating manner. When wall 13*a* moves up bellows walls 17*a* and 19*a* change from a folded to an extended position. This increases the volume of chamber 11*a*. When wall 13*a* moves downward bellows walls 17*a* and 19*a* change from an extended to a folded position. This decreases the volume of chamber 11*a*. The size and number of the folds in the bellows are such that the bellows allows a sufficient distance of travel of wall 13*a*. The natural bias of the bellows walls flexibility keeps walls 13*a* in a folded position. The walls of chamber 11*a* are made of good insulating materials such as plastic to prevent an exchange of heat between bellows chamber 11*a* and the environment. Penetrating the bottom wall 15*a* of chamber 11*a* is an inlet tube 20*a*. Chambers 11*a* and 11*b* are placed in a relative position which places movable walls 13*a* and 13*b* opposite each other. Present between movable walls 13*a* and 13*b* are rods 61. The rods are permanently attached to walls 13*a* and 13*b* and transmit movement from one wall to another, as will be explained. The distance between walls 15*a* and 15*b* is fixed by rods 12 which are attached to the sides of walls 15*a* and 15*b*. This prevents chambers 11*a* and 11*b* from moving towards and away from each other during the operation of the shoe temperature changer, as will be described. The distance between the chambers is such that each bellows is pulled or pushed to about half of their expansion or compression potential. This allows an equal up and down distance of travel by movable walls 13*a* and 13*b* between the chambers. The arrangement is such that the walls transmit opposing forces to each other. When the walls travel upward chamber 11*a*** expands and bellows 11b contracts. When the walls travel downward chamber 11a contracts and chamber 11b expands.

Communicating between chambers 11a and 11b, through walls 13a and 13b, is tube 81. Present in tube 81 is a valve 87. The valve is connected to wall 15a by valve actuator 89. The arrangement is that the valve actuator closes valve 87 when wall 13a is in its low position, and opens valve 87 when 13a reaches its upper limit of travel.

Incorporated in the side surfaces of the shoe is a net work of heat exchange tubes 21. The network functions as an evaporator chamber, as will be explained. The net work includes a bottom horizontal tube 23 and a top horizontal tube 25. Vertical and oblique tubes 27 are present between the horizontal tubes and communicate between tubes 23 and 25. The tubes and coils of network 21 are made of flexible plastic which follows the contour of the shoes, The tubes and coils provide heat exchange surfaces. Means such as surface extensions (not shown) to increase the area of the heat exchange surfaces may be used. Penetrating the top portion of tube 27 of network 21 is an outlet tube 29. Communicating between tubes 20a and tube 29 is a flexible tube 30. A one way valve 32 in tube 20a allows the entrance of vapor from network 21 to chamber 11a, but blocks the entrance of vapor from chamber 11a to network 21.

Present on the top outside surface of the neck of the shoe is a plastic or rubber insulating layer 34. Attached to insulator layer 34 is network 31. The shape of chamber 31 is such that it forms a layer on the outside surface of layer 34. The chamber functions as a condenser chamber, as will be explained. The net work includes vertical tubes 33 and 35. Horizontal tubes 37 are present between tubes 33 and 35 and communicate between tubes 33 and 35. Network 31 is made of good heat conducting materials, such as copper, to allow for a maximal transfer of heat from the walls of the collar to the outside environment. Means such as surface extensions (not shown) to increase the area of the heat exchange surfaces may be used. Penetrating the top portion of tube 33 of network 31 is an inlet tube 39. Communicating between tubes 20b and tube 39 is a flexible tube 41. A one way valve 43 in tube 20b allows the entrance of vapor from bellows chamber 11b to network 31 but blocks the entrance of vapor from network 31 to bellows chamber 11b.

Penetrating the bottom wall or vertical tube 35 is an outlet tube 51. Penetrating the top portion of horizontal tube 23 is an inlet tube 53. Communicating between tubes 51 and 53 is a flexible tube 55. Present in tube 51 is a floatation valve 57. Attached to valve 57 is a float 59. The arrangement is that the float responds to a liquid level in tube 35, so that when the liquid reaches a predetermined-determined level in the tube float 59 rises and opens valve 57. This allows a transfer of liquid from network 31 to network 21 by force of gravity.

Present in the lower portion of the inside of hollow heel 9 is another hollow heel 8. The cross-section of heel 8 is smaller than the cross section of heel 9, so that there is a an inter-space 91 between the heels. The height of heel 8 is such that the upper portion of heel 8 is present in heel 9, while the lower portion of heel 8 protrudes below heel 9. The height of the portion of heel 8 outside of heel 9 is at least as large as the distance of travel of the bellows movable walls. Heel 8 moves freely up and down in heel 9 and functions as a force transmitting agent, as will be described. The heel contains top wall 8a, bottom wall 8b, and side walls 8c, and 8d. The arrangement is that chamber 11b is placed inside heel 8. Top wall 8a of heel 8 is attached to top wall movable wall 13b of chamber 11a, so that heel 8 moves up and down together with movable walls 13a. Bars 12 penetrates heel 8 through small openings 71 in surface 8a, so that when the heel moves up and down the bars and the openings serve as a guide line to the movement. Tubes 30 and 81 penetrate though the walls of heel 8 to form a communication with components outside of heel 8, as previously described.

Present in the interior of all the components of the temperature changing system is an air vacuum. Present inside evaporator network 21 and condenser chamber 31 is a low boiling point liquid 52. The liquid may consist of low pressure liquids. such as water under an air vacuum. The air vacuum lowers the boiling point of the water and enhances its evaporation. Alternatively, the liquid may consist of high pressure low boiling point liquids, such as Forane 134A (tetrafluroethane) (F3CCH2F), an ozone sparring compound which is similar to Freon 12. The relative is quantity of liquid 52 is such that it partially fills networks 21 and 31, so that the level of liquid 52 divides networks 21 and 31 into bottom liquid phases, and top vapor phases.

The operation of the engine is as follows. When liquid 52 consists of water, the vapor maximal vapor pressure inside the chambers at ambient temperature is below atmospheric pressure. Atmospheric force will, therefore, push wall 13a downward, and wall 13b upward. Movable walls 13a and 13b will transmit these opposing vector forces to each other through rods 61. Thus, each wall will be subjected to a pushing vector force by the outside atmosphere, and a pulling vector force in the opposite direction by the movable wall of its adjacent container. When the temperatures in the chambers are equal to each other the vapor pressures in the chambers are equal to each other. The net atmospheric pushing force upon each wall is then equal to the opposite pulling force by its adjacent wall, The opposing forces upon the walls will then cancel each other. When heel 9 is raised above the ground, and no outside force is exerted upon movable walls 13a and 13b, the positions of walls 13a and 13b is determined primarily by the equal inherent flexibility or the bellows walls. The bellows will settle in their intermediate positions and heel 8 will rest in its low position.

When a person wearing the cooling shoes steps on heel 8 a pressure is exerted on the heel by the weight of the person wearing the shoes. The pressure will move heel 8 upward. The upward movement of heel 8 will move wall 13b upward. The upward movement of wall 13b will be transmitted to wall 13a through rods 61 which fix the distance between the walls. The upward movement of walls 13a and 13b will result in the expansion of chamber 11a and the compression of chamber 11b.

The expansion of the vapor in chamber 11a results in a reduction of the vapor pressure in the chamber to below the vapor pressures in network 21. A portion of the vapor in network 21, therefore, leaves the network through tube 30 and valve 32 to enter chamber 11a. The remaining vapor in network 21 then expands to fill the volume of the network. The relatively low vapor pressure in network 21 causes an additional evaporation of the low boiling point liquid 52 in the network, to restore the predetermined-expansion vapor pressure. The evaporation of the liquid causes the liquid to lose some of its heat content and to cool the coils of network 21.

The upward movement of movable wall 11*b* reduces the volume of chamber 11*b*. This causes a compression of the vapor in the chamber. The vapor pressure in chamber 11*b* will then exceed the vapor pressures in network 31. A portion of the vapor in chamber 11*b* will therefore enter condenser network 31 through tube 41 and valve 43. The entrance of additional vapor into network 31 will compress the vapor in the chamber. This causes a temperature increase of the vapor to above ambient temperature. The temperature differential causes the vapor to lose some of its heat content to the environment through the walls of the condenser network. Some of the vapor in 31 then re-condenses into a liquid. When wall 13*a* reaches its upper limit of travel valve actuator 89 opens valve 87 and a communication is established between the vapor phases in chambers 11*a* and 11*b* through tube 85.

When the person wearing the shoes lifts a foot from the ground, during the natural process of walking, the outside pressure upon movable walls 13*a* and 13*b* is removed. The position of the walls is then determined by the inherent flexibility of the bellows. This will return bellows 17*a* and 19*a* to their intermediate positions. When this occurs bellows chamber 11*a* contracts, and bellows chamber 11*b* expands. This will cause a transfer of vapor from chamber 11*a* to chamber 11*b*, through tube 81. When wall 13*a* reaches its lower limit of travel valve 87 closes tube and there is no communication between the chambers. When the person wearing the shoes steps on the ground an upward pressure is again exerted on walls 13*a* an 13*b* to renew the cycle of operation.

The re-condensed liquid accumulates in the lower portion of condenser 31. As the water accumulates in tube 33 it lifts float 59. When the float reaches a predetermined level it opens valve 57. When this occurs the re-condensed liquid returns to network 21 through tubes 51 and 55, by force of gravity, to continue the cycle of the cooling when the person using the shoe air conditioner is walking.

When liquid 52 consists of a liquid which generates vapor pressures which are above atmospheric pressures, movable walls will exert opposing pushing forces upon each other, instead of opposing pulling forces. The operation of the temperature changer will be similar the operation described above.

While the present embodiment of the invention has been adapted to change the temperature of shoes, it is understood that varieties of the invention may be used in other temperature changing systems, without departing from the essence of the invention as defined in the claims. These may include household air conditioner and refrigeration systems, When required other sources of energy, such as household electricity or batteries may be used to power the movements of walls 13*a* and 13*b*.

What is claimed is:

1. A temperature changing system, said temperature changing system includes at least two bellows chambers, wherein one chamber is adapted to act as an expander chamber, while the other chamber is adapted to act as a compressor chamber, a movable wall in each of said bellows chamber, said movable walls adapted to respond to outside pressures and inside pressures in said bellows chambers, a linkage between said movable walls which causes a transmission of vector forces from one of said movable wall to another, relative positions of said bellows chambers which cause the direction of movement of one of said movable walls to be opposite of the direction of movement of the other of said movable wall, a pressure inside of each of said chambers which is different from the pressure outside of said chamber, wherein said pressure differential exert a force upon the movable wall of each bellows chamber, means to fix the distance between said chambers to prevent a movement of said chambers towards and away from each other during the operation of said engine, said distance being of a dimension which causes each of said movable wall to transmit said force, induced by said pressure differential, to the other of said movable wall, wherein the positions of said movable walls, before operational force is applied to the system, are determined by the balance of opposing forces upon said movable walls, and wherein said positions allows an expansion of said expander chamber and a compression of said compressor chamber after operational force is applied to the system, means to apply a vector force upon the movable walls to tip the balance of forces between the movable walls and cause a movement of said walls, said movement adapted to cause an expansion of said expander chamber and a compression of said compressor chamber, wherein the expansion of said evaporator chamber causes the contraction of its adjacent compressor chamber, means to remove said vector force upon said movable walls to allow a return of said movable walls to their original positions, a network of coils communicating with said expander chamber, wherein said network function as an evaporator chamber, a network of coils communicating with said compressor chamber, wherein said network functions as a condenser chamber, a low boiling point fluid in said evaporator and condenser chambers wherein said fluid absorbs heat from its surroundings during the expansion of said expander chamber, and transfers heat to it surroundings during the compression of said compressor chambers, means allowing an entry of vapor from said compressor chamber to said condenser chamber but preventing an entry from said condenser chamber to said compressor chamber, means preventing passage of vapor from said expander chamber to said evaporator chamber, but allowing passage of vapor from said evaporator chamber to said expander chamber, means to transfer vapor from said expander chamber to said compressor chamber during the return of said expander and said compressor chambers to their original volumes, to re-condense said vapor into a liquid, and means to return said re-condensed liquid from said condenser chamber to said evaporator chamber.

2. A shoe temperature changing system said temperature changing system includes at least one bellows expander chamber and one bellows compressor chamber, said expander and compressor chambers adapted to be incorporated into the bottom surface of a shoe a movable wall in each of said chambers adapted to respond to inside and outside pressures upon said bellows chambers, a linkage between said movable walls which causes a transmission of vector forces from one of said movable wall to another, relative positions of said bellows chambers which cause the direction of movement of one of said movable walls to be opposite of the direction of movement of the other of said movable wall, a pressure inside of each of said chambers which is different from the pressure outside of said chamber, wherein said pressure differential exert a force upon the movable wall of each bellows chamber, means to fix the distance between said chambers to prevent a movement of said chambers towards and away from each other during the operation of said engine, said distance being of a dimension which causes each of said movable wall to transmit said force, induced by said pressure differential, to the other of said movable wall, wherein the positions of said movable walls, before operational force is applied to the system, are determined by the balance of opposing forces upon said movable walls, and wherein said positions allows an expansion of said expander chamber and a compression of said compressor chamber after operational force is applied to the system, force transmission means between the bottom surface of a shoe and said movable walls to transfer the force of body weight to said movable walls whenever a person wearing the shoe steps on said bottom surface, wherein said force expands said expander chamber and compresses said compressor chamber, a network of coils adapted to function as an evaporator chamber communicating with said expander chamber, a low boiling point liquid in said evaporator chamber, a communication between said evaporator and said expander chamber, one way valve means allowing passage from said expander chamber to said evaporator chamber but preventing passage from said condenser chamber to said flexible chamber, a network of coils adapted to function as a condenser chamber, a communication between said condenser and said compressor chamber, one way valve means allowing passage from said compressor chamber to said condenser, but preventing passage of from said condenser chamber to said compressor, means to associate said evaporator and said condenser chambers with the shoe's surfaces, one of said evaporator and condenser chambers placed in a position which favors a heat exchange between the chamber and the foot of the person wearing said shoe, while the other of said chambers placed in a position which favors a heat exchange between the chamber and the outside environment, means to transfer vapor from said expander chamber to said compressor chamber, to re-condense said vapor into a liquid, and means to return said re-condensed liquid from said condenser chamber to said evaporator chamber.

3. A heat transfer system consisting of at least two bellows chambers, wherein one chamber is adapted to expand, and the other of said chamber is adapted to be compressed, a movable wall in each of said bellows chamber, wherein said movable walls move in response to expansions and compressions of the bellows of said bellows chamber, a refrigerant consisting of a low boiling point liquid communicating with said bellows chambers, a pressure inside of each of said chambers which is different from the pressure outside of said each of said chamber wherein said pressure differential exerts a force upon each of said movable wall, relative positions of said bellows chambers which causes the direction of said force upon one movable walls to be opposite to the direction of said force upon the other of said movable wall, a linkage between said movable walls wherein said linkage transmits movement from one of said movable to the other, a fixed predetermined distance between said bellows chambers, said distance being of a dimension which causes each of said movable wall to transmit the said force acting upon itself to the other of said movable wall, before outside energy is applied to the system, and wherein the position of said movable walls is determined by the balance of opposing forces upon said movable walls, and wherein said position allows an expansion of said expander chamber and a compression of said compressor chamber after operational energy is applied to the system, means to transmit an outside vector force to at least one of said movable walls to tip said balance of opposing forces, wherein said vector force acts in a direction which forces the expansion of one of said bellows chambers and the compression of the other of said bellows chamber, a direct fluid communication between the interiors of said expander and compressor chamber, valve means to close said communication during the expansion of the expander chamber and the compression of the compressor chamber, and to open said communication after the movable walls of said expander and compressor chambers have reached their limit of travel, wherein said opening equalizes the vapor pressures between said expander and said compressor chambers and returns said movable walls to their starting positions.

4. The invention as described in claim 3 wherein said means to open and close said communication is operatively associated with the movements of said movable walls.

5. The invention as described in claim 1, wherein said low boiling point liquid exerts a vapor pressure which is below atmospheric pressure, and said movable walls exert an opposing pulling force upon each other.

6. The invention as described in claim 5 wherein said low boiling point liquid is water.

7. The invention as described in claim 1, wherein said low boiling point liquid exert a vapor pressure which is above atmospheric pressure, and said movable walls exert opposing pushing forces upon each other.

8. The invention as described in claim 1, wherein said opposing pressures consists of atmospheric pressures.

* * * * *